US011104970B2

(12) United States Patent
Wu et al.

(10) Patent No.: US 11,104,970 B2
(45) Date of Patent: Aug. 31, 2021

(54) METHOD OF PREPARING OLIGOSACCHARIDE USING BIOMASS SUGAR AS RAW MATERIAL

(71) Applicant: SOUTH CHINA UNIVERSITY OF TECHNOLOGY, Guangdong (CN)

(72) Inventors: Shubin Wu, Guangdong (CN); Xiao Liu, Guangdong (CN); Hao Cheng, Guangdong (CN); Jiajin Liang, Guangdong (CN); Weiqi Wei, Guangdong (CN); He Yang, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 16/760,042

(22) PCT Filed: Oct. 31, 2018

(86) PCT No.: PCT/CN2018/113240

§ 371 (c)(1),
(2) Date: Apr. 29, 2020

(87) PCT Pub. No.: WO2019/100920

PCT Pub. Date: May 31, 2019

(65) Prior Publication Data

US 2020/0263265 A1 Aug. 20, 2020

(30) Foreign Application Priority Data

Nov. 22, 2017 (CN) ..... 201711176659.2

(51) Int. Cl.
*C13K 13/00* (2006.01)

(52) U.S. Cl.
CPC ..... *C13K 13/00* (2013.01)

(58) Field of Classification Search
None
See application file for complete search history.

(56) References Cited

FOREIGN PATENT DOCUMENTS

| | | | |
|---|---|---|---|
| CN | 101659681 A | * | 3/2010 |
| CN | 106977556 | | 7/2017 |
| CN | 106977556 A | * | 7/2017 |
| CN | 108018380 | | 5/2018 |

OTHER PUBLICATIONS

Sugisawa et al, 1964 (Year: 1964).*
CN-101659681-A-English translation (Year: 2009).*
CN-106977556-A-English translation-Jul. 2017 (Year: 2017).*
"International Search Report (Form PCT/ISA/210) of PCT/CN2018/113240", dated Jan. 18, 2019, with English translation thereof, pp. 1-4.

* cited by examiner

*Primary Examiner* — Stefanie J Cohen
(74) *Attorney, Agent, or Firm* — JCIPRNET

(57) ABSTRACT

The present invention discloses a method of preparing oligosaccharide using biomass sugar as raw material. The method places a biomass sugar in a quartz tubular reactor, places the quartz tubular reactor at a temperature-controlled zone of a tubular thermal conversion reactor under the protection of nitrogen gas, controls a thermal conversion time, rapidly quenches a material to obtain an oligosaccharide precursor after thermal conversion ends, then dissolves by adding pure water and purifies through an inorganic ultrafiltration membrane, and finally obtain an oligosaccharide after drying.

7 Claims, No Drawings

METHOD OF PREPARING OLIGOSACCHARIDE USING BIOMASS SUGAR AS RAW MATERIAL

CROSS-REFERENCE TO RELATED APPLICATION

This application is a 371 of international application of PCT application serial no. PCT/CN2018/113240, filed on Oct. 31, 2018, which claims the priority benefit of China application no. 201711176659.2, filed on Nov. 22, 2017. The entirety of each of the above mentioned patent applications is hereby incorporated by reference herein and made a part of this specification.

TECHNICAL FIELD

The present invention relates to the field of oligomer preparation, and more specifically, relates to a method of rapidly preparing oligosaccharide using biomass sugar as raw material.

BACKGROUND

Oligosaccharide, also known as oligose, is a polymer in which a few monosaccharides (i.e. 2-10 monosaccharides) are linked together through glycosidic bonds, including functional oligosaccharide and ordinary oligosaccharide. Most kinds of the oligosaccharide have beneficial features for the human body, which integrating nutrition, healthcare and diet therapy. The oligosaccharides are widely applied in food, agriculture, beverage, medicine, feed additive and other fields. The research and application of oligosaccharides, especially functional oligosaccharides, will not only help improving the academic status of our country, but also form a new star industry in our country.

Biomass sugar includes glucose, fructose, xylose and oligosaccharide with lower polymerization. Monosaccharide such as glucose, fructose, and xylose are widely distributed, and has great yields. Common carbohydrate such as starch may also produce a variety of monosaccharide, disaccharide, and low-cost oligosaccharide through enzymolysis and/or hydrolysis, which may satisfy the production of oligosaccharides. Therefore, monosaccharide, disaccharide and low-cost oligosaccharide are excellent raw materials for preparing oligosaccharide.

Currently, commonly used methods for producing oligosaccharide are extraction from natural raw material, microwave solid-phase synthesis, acid-base conversion, and enzymatic hydrolysis. Most of the commonly used methods have disadvantages of long production cycle, high production cost, and the use or production of harmful chemicals in the production process. It is of great significance to research and develop a new method of rapidly, efficiently and greenly preparing oligosaccharide. The present invention proposes and improves a new method of rapidly preparing oligosaccharide using biomass sugar as raw material. The method can quickly and greenly prepare oligosaccharide, effectively improve the yield efficiency of oligosaccharide, and has high economic feasibility. The method provides a new approach for large-scale preparation and utilization of functional oligosaccharide.

SUMMARY OF THE INVENTION

The purpose of the present invention is to provide a method of rapidly preparing oligosaccharide using biomass sugar as raw material. The method simplifies production process, improves yield efficiency, and provides a new approach for large-scale preparation and utilization of functional oligosaccharide.

In order to achieve the above purpose, the present invention uses a technical solution as follows.

A method of rapidly preparing an oligosaccharide using a biomass sugar as raw material, includes the following steps:

(1) placing the biomass sugar in a quartz tubular reactor, then passing a high-purity nitrogen gas to replace air in the quartz tubular reactor. Setting a temperature of a tubular thermal conversion reactor to 300° C. to 700° C. When the temperature in the tubular thermal conversion reactor reaching the set temperature and being stable, placing the quartz tubular reactor at a temperature-controlled zone of the tubular thermal conversion reactor. Controlling a thermal conversion time to 10 seconds to 130 seconds, and then placing the quartz tubular reactor in a cooling liquid or air to quench, so as to obtain an oligosaccharide precursor;

(2) dissolving the oligosaccharide precursor obtained in step (1) by adding a pure water, so as to obtain an oligosaccharides-rich solution;

(3) purifying the oligosaccharide-rich solution obtained in step (2) through an inorganic ultrafiltration membrane, so as to obtain an oligosaccharide solution having a molecular weight within 1500;

(4) drying the oligosaccharide solution obtained in step (3), so as to obtain the oligosaccharide.

Preferably, in step (1), the biomass sugar is one or a plurality of monosaccharide, disaccharide and oligosaccharide obtained by an enzymolysis or a hydrolysis of a carbohydrate. A purity of the biomass sugar is higher than 95%.

More preferably, in step (1), the biomass sugar is one or a plurality of glucose, cellobiose, cellotriose, cellotetraose, cellopentaose, xylose, xylobiose, xyltriose, xylotetraose, xylopentaose, fructose, lactose, kestose, nystose and kestopentaose.

Even more preferably, in step (1), the biomass sugar is one or a plurality of glucose, xylose and fructose.

When there is a plurality of kinds of the biomass sugar, the plurality of kinds of the biomass sugar are fully mixed by physical powder mixing and the mixed powder is then placed in the quartz tubular reactor.

Preferably, in step (1), a time interval of an operation from moving a material out of the tubular thermal conversion reactor until quenching the material in the cooling liquid is controlled within 5 seconds.

Preferably, in step (1), the cooling liquid is one or a plurality of liquid nitrogen, ice water and room temperature water.

Preferably, in step (1), a time of the quenching is 5 seconds to 60 seconds.

Preferably, in step (2), an amount of the pure water is 3 times to 10 times of a mass of the oligosaccharide precursor.

Preferably, in step (3), an aperture diameter of the inorganic ultrafiltration membrane is 50 nm to 200 nm.

Preferably, in step (3), a pressure of the purifying is 0.8 MPa to 1.2 MPa.

Preferably, in step (4), the drying is one or a plurality of freeze drying, vacuum drying and spray drying.

In comparison with the prior art, the present invention has the following advantages:

(1) The present invention proposes and improves a method of rapidly preparing oligosaccharide. In comparison with the traditional enzymatic hydrolysis method, the present invention has the advantages of simple production process, high yield efficiency and strong economic feasibility.

(2) The raw materials of the present invention are from a wide range of sources, and have no chemical consumption and environmental pollution.

(3) The present invention provides a new method for large-scale preparation and utilization of functional oligosaccharide.

DETAILED DESCRIPTION OF THE PREFERRED EMBODIMENT

The embodiments of the present invention will be further described below with reference to examples, however, the embodiments and the protection scope of the present invention are not limited thereto.

In specific embodiments, a purity of a biomass sugar raw material is higher than 95 wt %; a content of an oligosaccharide is analyzed by ion chromatography, in which the calculation method of the oligosaccharide is as follows:

$$Y=(C\times V)/M\times 100\%;$$

wherein, Y represents a yield rate (g/100 g raw material) of an oligosaccharide; C represents an oligosaccharide concentration (g/L) in an oligosaccharide-rich solution after purifying; V represents a solution volume (L) of the oligosaccharide-rich solution after purifying; M represents a mass (g) of the biomass sugar raw material.

Embodiment 1

A method of rapidly preparing oligosaccharide using biomass sugar as raw material includes the following steps:

(1) Weighing and evenly dispersing a 300 mg glucose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 300° C. and being stable, placing the quartz tubular reactor at the center of a heating zone of the thermal conversion reactor; when the reaction proceeds to 120 seconds, rapidly, within 5 seconds, removing and placing the quartz tubular reactor in air to quench for 60 seconds, so as to obtain a cello-oligosaccharide precursor;

(2) dissolving the cello-oligosaccharide precursor by adding pure water having a volume that is 6 times a volume of the cello-oligosaccharide precursor, so as to obtain a cello-oligosaccharide-rich solution, then purifying the solution using a 100 nm inorganic ultrafiltration membrane with a 1 MPa purifying pressure, so as to obtain a cello-oligosaccharide solution having a molecular weight within 1500; then measuring a total glucose amount of the solution after purifying by ion chromatography, and an amount of a cello-oligosaccharide is a difference between an amount of the solution after purifying and the total glucose amount; a measurement result of the amount of the cello-oligosaccharide is shown in Table 1.

(3) freeze-drying the solution after purifying to prepare the cello-oligosaccharide.

Embodiment 2

A method of rapidly preparing oligosaccharide using biomass sugar as raw material includes the following steps:

(1) Weighing and evenly dispersing a 300 mg glucose powder in the bottom of a quartz tubular reactor, passing in a high-purity nitrogen gas to replace air in the quartz tube to ensure that a reaction proceeds in an inert atmosphere; turning on power of a tubular thermal conversion reactor; when a temperature of the tubular thermal conversion reactor rising to 500° C. and being stable, placing the quartz tubular reactor at the center of a heating zone of the thermal conversion reactor; when the reaction proceeds to 60 seconds, rapidly, within 5 seconds, removing and placing the quartz tubular reactor in ice water to quench for 30 seconds, so as to obtain a cello-oligosaccharide precursor;

(2) dissolving the cello-oligosaccharide precursor by adding pure water having a volume that is 10 times a volume of the cello-oligosaccharide precursor, so as to obtain a cello-oligosaccharide-rich solution, then purifying the solution using a 200 nm inorganic ultrafiltration membrane with a 0.8 MPa purifying pressure, so as to obtain a cello-oligosaccharide solution having a molecular weight within 1500; then measuring a total glucose amount of the solution after purifying by ion chromatography, and an amount of a cello-oligosaccharide is a difference between an amount of the solution after purifying and the total glucose amount; a measurement result of the amount of the cello-oligosaccharide is shown in Table 1.

(3) spray-drying the solution after purifying to prepare the cello-oligosaccharide.

Embodiment 3

A method of rapidly preparing oligosaccharide using biomass sugar as raw material includes the following steps:

(1) Weighing and evenly dispersing a 300 mg glucose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 700° C. and being stable, placing the quartz tubular reactor at the center of a heating zone of the thermal conversion reactor; when the reaction proceeds to 10 seconds, rapidly, within 5 seconds, removing and placing the quartz tubular reactor in room temperature water to quench for 5 seconds, so as to obtain a cello-oligosaccharide precursor;

(2) dissolving the cello-oligosaccharide precursor by adding pure water having a volume that is 3 times a volume of the cello-oligosaccharide precursor, so as to obtain an cello-oligosaccharide-rich solution, then purifying the solution using a 50 nm inorganic ultrafiltration membrane with a 1.2 MPa purifying pressure, so as to obtain a cello-oligosaccharide solution having a molecular weight within 1500; then measuring a total glucose amount of the solution after purifying by ion chromatography, and an amount of a cello-oligosaccharide is a difference between an amount of the solution after purifying and the total glucose amount; a measurement result of the amount of the cello-oligosaccharide is shown in Table 1.

(3) vacuum-drying the solution after purifying to prepare the cello-oligosaccharide.

Embodiment 4

A method of rapidly preparing oligosaccharide using biomass sugar as raw material includes the following steps:

(1) Weighing and evenly dispersing a 300 mg fructose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 400° C. and being stable, placing the quartz tubular reactor at the center of a heating zone of the thermal conversion reactor; when the reaction proceeds to 60 seconds, rapidly, within 5 seconds, removing and placing the quartz tubular reactor in a liquid nitrogen to quench for 30 seconds, so as to obtain a fructo-oligosaccharide precursor;

(2) dissolving the fructo-oligosaccharide precursor by adding pure water having a volume that is 5 times a volume of the fructo-oligosaccharide precursor, so as to obtain a fructo-oligosaccharide-rich solution, then purifying the solution using a 120 nm inorganic ultrafiltration membrane with a 0.8 MPa purifying pressure, so as to obtain a fructo-oligosaccharide solution having a molecular weight within 1500; then measuring a total fructose amount of the solution after purifying by ion chromatography, and an amount of a fructo-oligosaccharide is a difference between an amount of the solution after purifying and the total fructose amount; a measurement result of the amount of the fructo-oligosaccharide is shown in Table 1.

(3) freeze-drying the solution after purifying to prepare the fructo-oligosaccharide.

Embodiment 5

A method of rapidly preparing oligosaccharide using biomass sugar as raw material includes the following steps:

(1) Weighing and evenly dispersing a 300 mg cellobiose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 600° C. and being stable, placing the quartz tubular reactor at the center of a heating zone of the thermal conversion reactor; when the reaction proceeds to 25 seconds, rapidly, within 5 seconds, removing and placing the quartz tubular reactor in ice water to quench for 25 seconds, so as to obtain a cello-oligosaccharide precursor;

(2) dissolving the cello-oligosaccharide precursor by adding pure water having a volume that is 3 times a volume of the cello-oligosaccharide precursor, so as to obtain a cello-oligosaccharide-rich solution, then purifying the solution using a 100 nm inorganic ultrafiltration membrane with a 1.2 MPa purifying pressure, so as to obtain a cello-oligosaccharide solution having a molecular weight within 1500; then measuring a total glucose amount of the solution after purifying by ion chromatography, and an amount of a cello-oligosaccharide is a difference between an amount of the solution after purifying and the total glucose amount; a measurement result of the amount of the cello-oligosaccharide is shown in Table 1.

(3) freeze-drying the solution after purifying to prepare the cello-oligosaccharide.

Embodiment 6

A method of rapidly preparing oligosaccharide using biomass sugar as raw material includes the following steps:

(1) Weighing and evenly dispersing a 300 mg xylose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 700° C. and being stable, placing the quartz tubular reactor at the center of a heating zone of the thermal conversion reactor; when the reaction proceeds to 15 seconds, rapidly, within 5 seconds, removing and placing the quartz tubular reactor in room temperature water to quench for 60 seconds, so as to obtain a xylo-oligosaccharide precursor;

(2) dissolving the xylo-oligosaccharide precursor by adding pure water having a volume that is 6 times a volume of the xylo-oligosaccharide precursor, so as to obtain a xylo-oligosaccharide-rich solution, then purifying the solution using a 100 nm inorganic ultrafiltration membrane with a 1 MPa purifying pressure, so as to obtain a xylo-oligosaccharide solution having a molecular weight within 1500; then measuring a total xylose amount of the solution after purifying by ion chromatography, and an amount of a xylo-oligosaccharide is a difference between an amount of the solution after purifying and the total xylose amount; a measurement result of the amount of the xylo-oligosaccharide is shown in Table 1.

(3) spray-drying the solution after purifying to prepare the xylo-oligosaccharide.

Embodiment 7

A method of rapidly preparing oligosaccharide using biomass sugar as raw material includes the following steps:

(1) Weighing, physically mixing in a form of powder and then dispersing a 150 mg glucose powder and a 150 mg fructose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 600° C. and being stable, placing the quartz tubular reactor at the center of a heating zone of the thermal conversion reactor; when the reaction proceeds to 30 seconds, rapidly, within 5 seconds, removing and placing the quartz tubular reactor in liquid nitrogen to quench for 35 seconds, so as to obtain an oligosaccharide precursor;

(2) dissolving the oligosaccharide precursor by adding pure water having a volume that is 5 times a volume of the oligosaccharide precursor, so as to obtain an oligosaccharide-rich solution, then purifying the solution using a 150 nm inorganic ultrafiltration membrane with a 1.2 MPa purifying pressure, so as to obtain an oligosaccharide solution having a molecular weight within 1500; then measuring a total monosaccharide amount of the solution after purifying by ion chromatography, and an amount of an oligosaccharide is a difference between an amount of the solution after purifying and the total monosaccharide amount; a measurement result of the amount of the oligosaccharide is shown in Table 1.

(3) vacuum-drying the solution after purifying to prepare the oligosaccharide.

Embodiment 8

A method of rapidly preparing oligosaccharide using biomass sugar as raw material includes the following steps:

(1) Weighing, physically mixing in a form of powder and then dispersing a 100 mg glucose powder, a 100 mg xylose powder and a 100 mg fructose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 500° C. and being stable, placing the quartz tubular reactor at the center of a heating zone of the thermal conversion reactor; when the reaction proceeds to 50 seconds, rapidly, within 5 seconds, removing and placing the quartz tubular reactor in liquid nitrogen to quench for 40 seconds, so as to obtain an oligosaccharide precursor;

(2) dissolving the oligosaccharide precursor by adding pure water having a volume that is 5 times a volume of the precursor oligosaccharide, so as to obtain an oligosaccharide-rich solution, then purifying the solution using a 150 nm inorganic ultrafiltration membrane with a 0.8 MPa purifying pressure, so as to obtain an oligosaccharide solution having a molecular weight within 1500; then measuring a total monosaccharide amount of the solution after purifying by ion chromatography, and an amount of an oligosaccharide is a difference between an amount of the solution after purifying and the total monosaccharide amount; a measurement result of the amount of the oligosaccharide is shown in Table 1.

(3) freeze-drying the solution after purifying to prepare the oligosaccharide.

Embodiment 9

A method of rapidly preparing oligosaccharide using biomass sugar as raw material includes the following steps:

(1) Weighing, physically mixing in a form of powder and then dispersing a 100 mg glucose powder, a 100 mg cellobiose powder and a 100 mg xylobiose powder in the bottom of a quartz tubular reactor, passing in a high-purity nitrogen gas to replace air in the quartz tube to ensure that a reaction proceeds in an inert atmosphere; turning on power of a tubular thermal conversion reactor; when temperature of the tubular thermal conversion reactor rising to 600° C. and being stable, placing the quartz tubular reactor at the center of a heating zone of the thermal conversion reactor; when the reaction proceeds to 30 seconds, rapidly, within 5 seconds, removing and placing the quartz tubular reactor in room temperature water to quench for 35 seconds, so as to obtain a oligosaccharide precursor;

(2) dissolving the oligosaccharide precursor by adding pure water having a volume that is 3 times a volume of the precursor oligosaccharide, so as to obtain an oligosaccharide-rich solution, then purifying the solution using a 100 nm inorganic ultrafiltration membrane with a 1 MPa purifying pressure, so as to obtain an oligosaccharide solution having a molecular weight within 1500; then measuring a total monosaccharide amount of the solution after purifying by ion chromatography, and an amount of an oligosaccharide is a difference between an amount of the solution after purifying and the total monosaccharide amount; a measurement result of the amount of the oligosaccharide is shown in Table 1.

(3) freeze-drying the solution after purifying to prepare the oligosaccharide.

TABLE 1

Yield rates of preparing oligosaccharide using biomass sugar as raw material in Embodiments 1-9

| | Conditions of preparing | | | | | | |
|---|---|---|---|---|---|---|---|
| Embodiment | Temperature of thermal conversion reactor/° C. | Reaction time/s | Quenching method | Quenching time/s | Aperture diameter/nm | Purifying pressure/MPa | Yield rate of oligosaccharide (g/100 g raw material) |
| 1 | 300 | 120 | Air | 60 | 100 | 1 | 50.22 |
| 2 | 500 | 60 | Ice water | 30 | 200 | 0.8 | 52.98 |
| 3 | 700 | 10 | Room temperature water | 5 | 50 | 1.2 | 49.13 |
| 4 | 400 | 60 | Liquid nitrogen | 30 | 120 | 0.8 | 39.64 |
| 5 | 600 | 25 | Ice water | 25 | 100 | 1.2 | 51.64 |
| 6 | 700 | 15 | Room temperature water | 60 | 100 | 1 | 41.39 |
| 7 | 600 | 30 | Liquid nitrogen | 35 | 150 | 1.2 | 42.06 |
| 8 | 500 | 50 | Liquid nitrogen | 40 | 150 | 0.8 | 46.33 |
| 9 | 600 | 30 | Room temperature water | 35 | 100 | 1 | 44.02 |

As can be seen from Table 1, an oligosaccharide can be obtained by a thermal conversion in a short time by selecting different biomass sugars. In addition, for different reaction temperatures and quenching methods, reaction time and quenching time may be adjusted, so that a conversion of the selected biomass sugar may obtain an oligosaccharide with higher yield rates under appropriate ultrafiltration membrane filtering. After passing through the ultrafiltration membrane at lower reaction temperature (300° C. to 500° C.) and longer reaction time (≥605) through air or ice water quenching method, as well as passing through the ultrafiltration membrane in faster reaction time (15 s to 30 s) and higher reaction temperature (>500° C.) through liquid nitrogen or room temperature water quenching method, the conversion of the selected biomass sugar may obtain the oligosaccharide with higher yield rates. The yield rate of the oligosaccharide is affected by factors such as reaction temperature, reaction time, quenching method, quenching time, and characteristics of the ultrafiltration membrane, which results in having greater room for improvement. Also, provides the possibility for effectively improving the yield efficiency of the oligosaccharide, and provides a new approach for large-scale preparation and utilization of functional oligosaccharide.

The present invention uses specific examples to illustrate the principle and implementation of the present invention, however, does not limit the implementation of the present invention. For those with ordinary skills in the art, changes and modifications in other different forms can be made based on the above description. It is neither needed nor possible to list all implementations herein. Any improvements, substitutions and modifications made without departing from the spirit and principle of the present invention, are included in the protection scope of the claims of the present invention.

What is claimed:

1. A method of rapidly preparing an oligosaccharide using a biomass sugar as raw material, characterized in that, the method comprises the following steps:

(1) placing the biomass sugar in a quartz tubular reactor, then passing a high-purity nitrogen gas to replace air in the quartz tubular reactor, setting a temperature of a tubular thermal conversion reactor to 300° C. to 400° C., when the temperature in the tubular thermal conversion reactor reaching the set temperature and being stable, placing the quartz tubular reactor at a temperature-controlled zone of the tubular thermal conversion reactor, controlling a thermal conversion time to 50 seconds to 120 seconds, and then placing the quartz tubular reactor in a cooling liquid or air to quench, so as to obtain an oligosaccharide precursor; a time of quenching is 25 seconds to 60 seconds;

(2) dissolving the oligosaccharide precursor obtained in step (1) by adding a pure water, so as to obtain an oligosaccharides-rich solution; an amount of the pure water is 6 times to 10 times of a mass of the oligosaccharide precursor;

(3) purifying the oligosaccharide-rich solution obtained in step (2) through an inorganic ultrafiltration membrane, so as to obtain an oligosaccharide solution having a molecular weight within 1500; and a pressure of the purifying is 0.8 MPa to 1.2 MPa;

(4) drying the oligosaccharide solution obtained in step (3), so as to obtain the oligosaccharide.

2. The method according to claim 1, characterized in that, in step (1), the biomass sugar is one or a plurality of monosaccharide, disaccharide and oligosaccharide obtained by an enzymolysis or a hydrolysis of a carbohydrate, and a purity of the biomass sugar is higher than 95%.

3. The method according to claim 1, characterized in that, in step (1), the biomass sugar is one or a plurality of glucose, cellobiose, cellotriose, cellotetraose, cellopentaose, xylose, xylobiose, xyltriose, xylotetraose, xylopentaose, fructose, lactose, kestose, nystose and kestopentaose.

4. The method according to claim 1, characterized in that, in step (1), a time interval of an operation from moving a material out of the tubular thermal conversion reactor until quenching the material in the cooling liquid is controlled within 5 seconds.

5. The method according to claim 1, characterized in that, in step (1), the cooling liquid is one or a plurality of liquid nitrogen, ice water and room temperature water.

6. The method according to claim 1, characterized in that, in step (3), an aperture diameter of the inorganic ultrafiltration membrane is 50 nm to 200 nm.

7. The method according to claim 1, characterized in that, in step (4), the drying is one or a plurality of freeze drying, vacuum drying and spray drying.

* * * * *